United States Patent [19]

Parks et al.

[11] Patent Number: 4,914,266

[45] Date of Patent: Apr. 3, 1990

[54] PRESS APPLIED SUSCEPTOR FOR CONTROLLED MICROWAVE HEATING

[75] Inventors: Christopher J. Parks, Ellicott City, Md.; Kenneth J. Wolfe, State College, Pa.

[73] Assignee: Westvaco Corporation, New York, N.Y.

[21] Appl. No.: 327,514

[22] Filed: Mar. 22, 1989

[51] Int. Cl.[4] ..... H05B 6/64

[52] U.S. Cl. ..... 219/10.55 E; 219/10.55 F; 219/10.55 M; 426/107; 426/234; 426/243; 99/DIG. 14; 428/34.2; 427/288

[58] Field of Search ..... 219/10.55 E, 10.55 F, 219/10.55 M, 10.55 R; 426/107, 109, 112, 113, 241, 243, 234; 99/DIG. 14; 126/390; 427/288, 261, 264, 258; 428/34.2; 156/233

[56] References Cited

U.S. PATENT DOCUMENTS

| | | | |
|---|---|---|---|
| 2,014,760 | 9/1935 | Dewsbury et al. . | |
| 4,190,757 | 2/1980 | Turpin et al. | 219/10.55 E |
| 4,230,924 | 10/1980 | Brastad et al. | 219/10.55 E |
| 4,267,420 | 5/1981 | Brastad | 219/10.55 E |
| 4,434,197 | 2/1984 | Petriello et al. | 219/10.55 E |
| 4,518,651 | 5/1985 | Wolfe, Jr. | 219/10.55 E |
| 4,595,611 | 6/1986 | Quick et al. . | |
| 4,641,005 | 2/1987 | Seiferth | 219/10.55 E |
| 4,676,857 | 6/1987 | Scharr et al. | 426/107 X |
| 4,777,053 | 10/1988 | Tobelmann et al. | 426/107 |
| 4,801,774 | 1/1989 | Hart | 219/10.55 E |

FOREIGN PATENT DOCUMENTS

| | | |
|---|---|---|
| 0276654 | 8/1988 | European Pat. Off. . |

*Primary Examiner*—Philip H. Leung

[57] ABSTRACT

Paperboard packaging material is disclosed for use in the manufacture of cartons for heating and browning food in a microwave oven. In accordance with the present invention, a pattern of microwave susceptor is printed on paperboard packaging material using a susceptor-ink composition in the areas where the food is to be browned. The susceptor-ink composition comprises an ink vehicle into which there is incorporated a conductive carbon material such as graphite or carbon black as the susceptor material. The preferred printing process is by gravure, and the printed susceptor is overcoated with an FDA approved food contacting coating.

14 Claims, 6 Drawing Sheets

PRESS APPLIED SUSCEPTOR FOR CONTROLLED MICROWAVE HEATING

BACKGROUND OF INVENTION

The present invention relates to paperboard packaging material and packages constructed therefrom, and more particularly to packaging useful for heating and browning foods in a microwave oven, commonly known in the trade as susceptor packaging.

One of the problems associated with the use of microwave energy for cooking is that is fails to brown and crisp those foods which are normally expected to have such a quality. Many attempts have been made to correct this deficiency including modifications to the microwave oven, the development of new cooking utensils, and more recently, the development of susceptor packaging to solve the browning problem. The most commonly available susceptor packaging on the market today involves the use of metallized films as the susceptor material which are incorporated into the food package, or added as inserts into the food package. The metallized films are generally laminated to the packaging material used to make the food packages, or to the substrates used as inserts. Unfortunately, the use of packages or inserts containing metallized film have only met with limited success. U.S. Pat. Nos. 4,230,924; 4,267,420; and 4,641,005 are typical of those which disclose the use of metallized films in the packaging material.

Another method for adding the susceptor material to the packaging material involves a hot stamping transfer process as taught by U.S. Pat. No. 4,676,857. In this patent, aluminum roll leaf is hot stamped in a variety of patterns onto trays or the like in which the food is cooked. However, this process is tedious and requires specialized equipment.

In contrast to the aforementioned methods of manufacturing susceptor packaging, the present invention comprises a printing process using conventional printing techniques and a solvent based ink vehicle for applying a susceptor material such as conductive carbon, in the form of carbon black or graphite, in selected locations on the packaging material. The use of particulate conductive carbon as a microwave absorber is taught by U.S. Pat. No. 4,518,651, but in that patent, the carbon is dispersed generally in a laminated composite material which makes it no more useful than a metallized film laminate. In addition, U.S. Pat. No. 2,014,760 teaches a printing ink containing graphite, but there is no suggestion that the ink is conductive. Meanwhile, in European Patent Application EP 0 276 654, a susceptor film is disclosed comprising a cross linking and heat resistant synthetic binders which contains evenly distributed particles such as natural and synthetic graphite particles and carbon black particles. An aqueous system is disclosed which may be applied in a printing step as a continuous layer or only in discrete areas. However, according to the present invention, the conductive carbon susceptor material is dispersed in a solvent susceptor-ink composition for application to the packaging material using conventional ink technology.

SUMMARY OF INVENTION

Carbon and graphite are both conductive carbon materials that are available in particle sizes which may be readily dispersed into solvent based inks. Inks incorporating these materials can then be printed on coated or uncoated paperboard packaging material, and preferably polyester coated paperboard substrates, in any prescribed pattern with known printing methods and equipment. Furthermore, by overprinting the desired patterns, or by varying the concentration of the carbon susceptor material within the prescribed pattern, the concentration of susceptor material applied in the prescribed pattern can be controlled to obtain useful time-temperature profiles for the most effective browning of different kinds of food. After printing the susceptor material according to the present invention, the packaging material can be converted into any desired package shape using conventional methods. Any of a number of desirable results can thus be achieved. For instance, breaded products such as fish sticks or breaded vegetables, doughy products such as pizza crust or sandwiches, and other starchy products such a french fried potatoes can be crisped and/or browned during microwave cooking by heating their surfaces to temperatures high enough to dry their surfaces. These temperatures are greater than about 212 degrees F., and depending on the type of food product may be as high as 450 degrees F. By varying the thickness of the carbon susceptor material only in the part of the food package which contacts the surface of those foods, it is possible to reach and maintain the elevated temperatures at those locations long enough to achieve the crisping or browning result without overheating other parts of the package.

In multi-component meals, each of the food components receives energy in ways that are dependent on the shape and moisture content of the food component. In order to have each food component reach its desired state of doneness at the same time, it is necessary to control the rate at which it is receiving microwave energy. This can be accomplished by changing the shape or moisture content of the food product, but it is more desirable to accomplish this with external means. By applying susceptor coatings to the food package having varying concentrations of susceptor material adjacent to the different food products, it is possible to control the rate of heating and temperature of the package in those areas. This will result in cooking the different food components at rates appropriate for those components.

DETAILED DESCRIPTION

Figure 1:
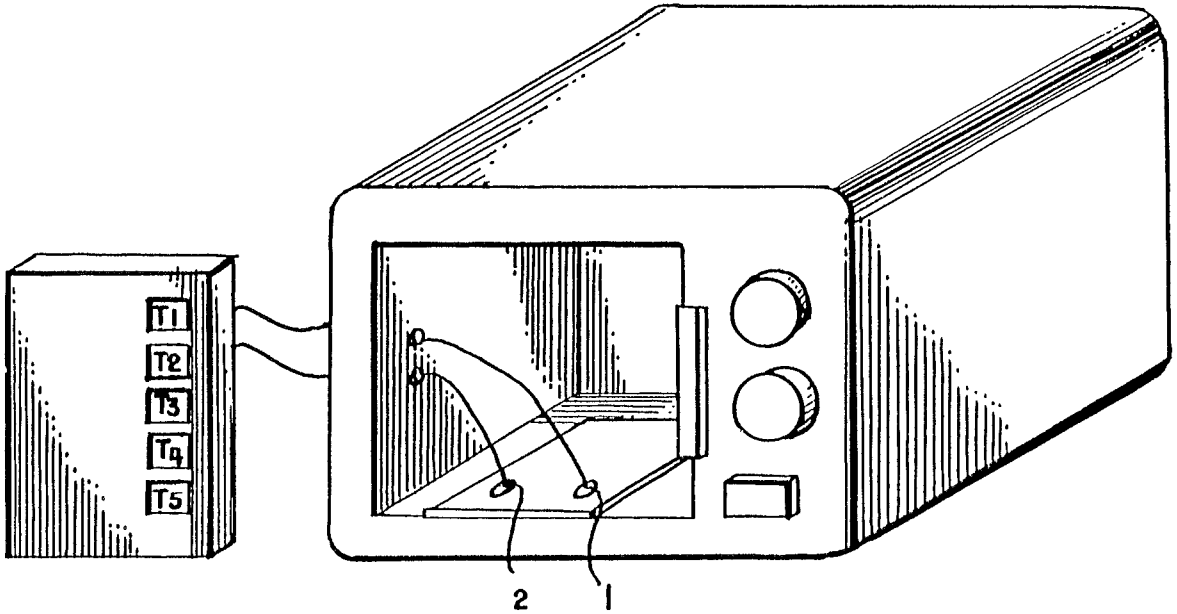
FIG. 1 is a perspective view of a microwave test-oven including a paperboard sample with temperature probes attached.

The present invention is directed to the use of graphite or a conductive carbon black susceptor material in the manufacture of packaging material for the microwave oven. The susceptor material is dispersed in an ink vehicle to produce a susceptor-ink composition which is printed on a suitable paperboard substrate such as polymer coated paperboard using conventional ink technology. The printed susceptor is then overcoated with a barrier coating suitable to provide an FDA approved food contact surface. An example of such a barrier coating is Eastman 8593 which is an aqueous dispersion of a sulfonated polyethylene terephthalate polyester resin supplied by Eastman Chemical Company and fully disclosed in U.S. Pat. No. 4,595,611. The susceptor-ink composition is preferably printed on the paperboard substrate using a rotogravure printing press. The pattern printed on the substrate preferably varies in concentration to correspond with the location and type of food in the package made with the susceptor packaging material. The addition of the susceptor material to the package causes the temperature of the package in the susceptor areas to be greater during microwave cooking than areas without susceptor material, and to vary depending upon the concentration of the susceptor material, to achieve uniform cooking, and browning and crisping of the food products.

Since its inception, rotogravure printing has been carried out primary with solvent based inks. Accordingly, a solvent based susceptor-ink is preferred for the printing process of the present invention. Typical ink vehicles useful in the present invention comprise a mixture of resins and solvents. The resins may include polymeric cellulosic resins soluble in alcohol but insoluble in water such as cellulose nitrate (nitrocellulose), cellulose acetate, methyl cellulose, ethyl cellulose and cellulose acetate butyrate. In susceptorinks containing nitrocelluose, the nitrocelluose imparts tack or stickiness to the ink. The function of the solvent in the ink vehicle is to dissolve the organic ingredients and hold them in solutions. Alcohol, the term usually applied to ethyl alcohol or ethanol is an example of a solvent useful in the present invention which may also include allyl, amyl, benzyl, butyl, cetyl, isobutyl, isopropyl and propyl alcohols.

In preliminary trials, susceptor-ink printed paperboard samples were prepared and temperature profiles measured to determine the versatility of the present invention for both pattern printing applications and control of heating rate. Three susceptor-ink compositions were prepared as follows by a commercial ink supplier, Southern Printing Inks, Richmond, Va.

| Ingredients | Weight % |
|---|---|
| Composition I | |
| Resin (Nitrocellulose) | 18.0 |
| Solvent (Mixture) | 73.0 |
| Graphite (Micro 250) | 9.0 |
| | 100.0% |
| Composition II | |
| Resin (Nitrocellulose) | 16.5 |
| Solvent (Mixture) | 66.8 |
| Graphite (Micro 250) | 16.7 |
| | 100.0% |
| Composition III | |
| Resin (Nitrocellulose) | 14.1 |
| Solvent (Mixture) | 57.3 |
| Graphite (Micro 250) | 28.6 |
| | 100.0% |

The solvent mixture consisted of varying percents of ethanol, isopropyl acetate and isopropyl alcohol, and the MICRO 250 graphite is a product of Asbury Graphite Mills, Asbury, N.J. The susceptor-ink compositions were printed on paperboard samples using a gravure cylinder having 150 lines per inch, one or two bumps. The samples were cut into rectangular shape and temperature probes placed on the samples as shown in FIG. 1. Each sample was then cooked in a 700 watt, 1.4 cuft microwave oven at high power for 5 minutes while temperature readings were taken by the temperature probes. The temperature profiles obtained are shown in FIGS. 2–5.

The time-temperature graphs shown in FIGS. 2–5 demonstrate the heating effect that can be achieved by printing a susceptor-ink composition on paperboard according to the present invention. The concentration of susceptor material can be varied in a selector location by varying the amount of susceptor material in the ink film; by overprinting selected locations with more than one ink film thickness; or, when using the gravure printing method, by varying the lines per linear inch on the print roll. The printed susceptor films preferably have a surface resistivity in the range of from about 50–5000 ohms per square. The resistivity of the susceptor-ink can be changed by changing the particle size of the graphite pigment, the concentration of graphite or by changing the crystallinity of the resin.

Figure 2:
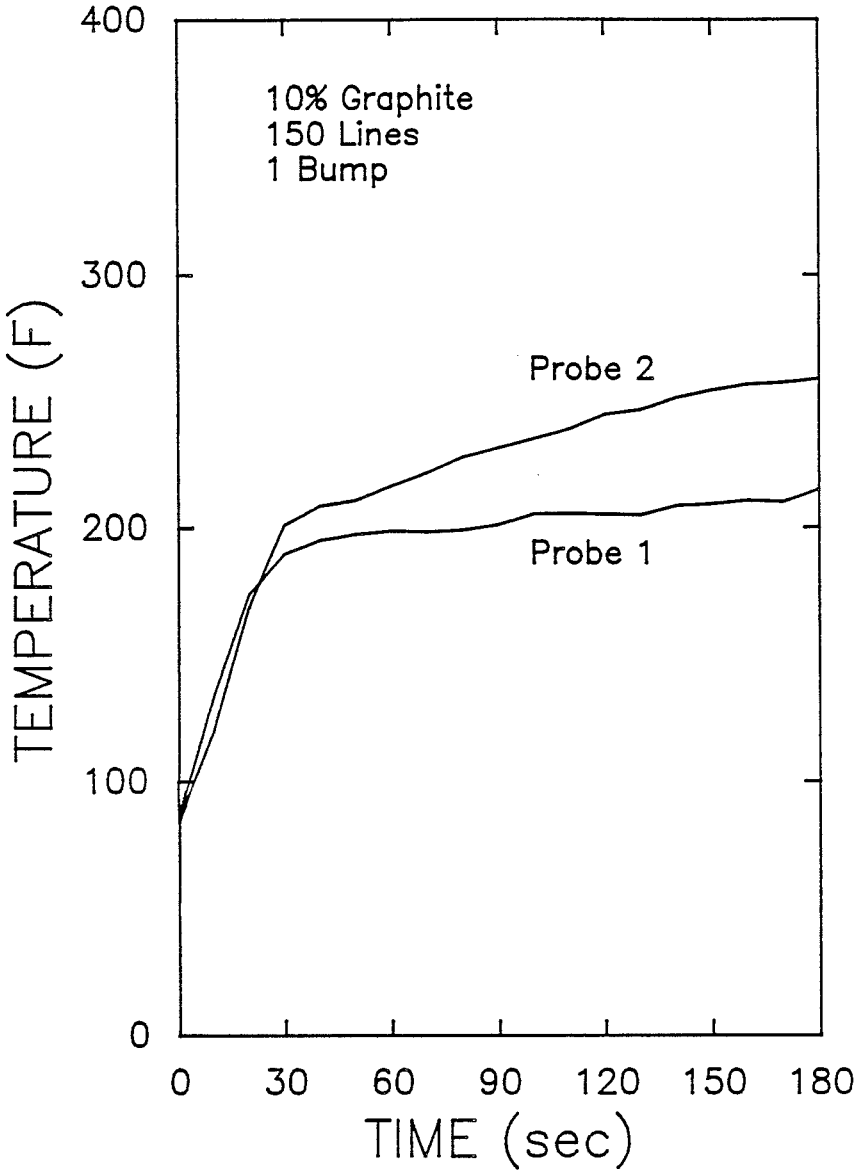
FIG. 2 is a time-temperature graph showing the temperature profile achieved in the microwave test-oven with susceptor-ink composition I printed one bump.
Figure 3:
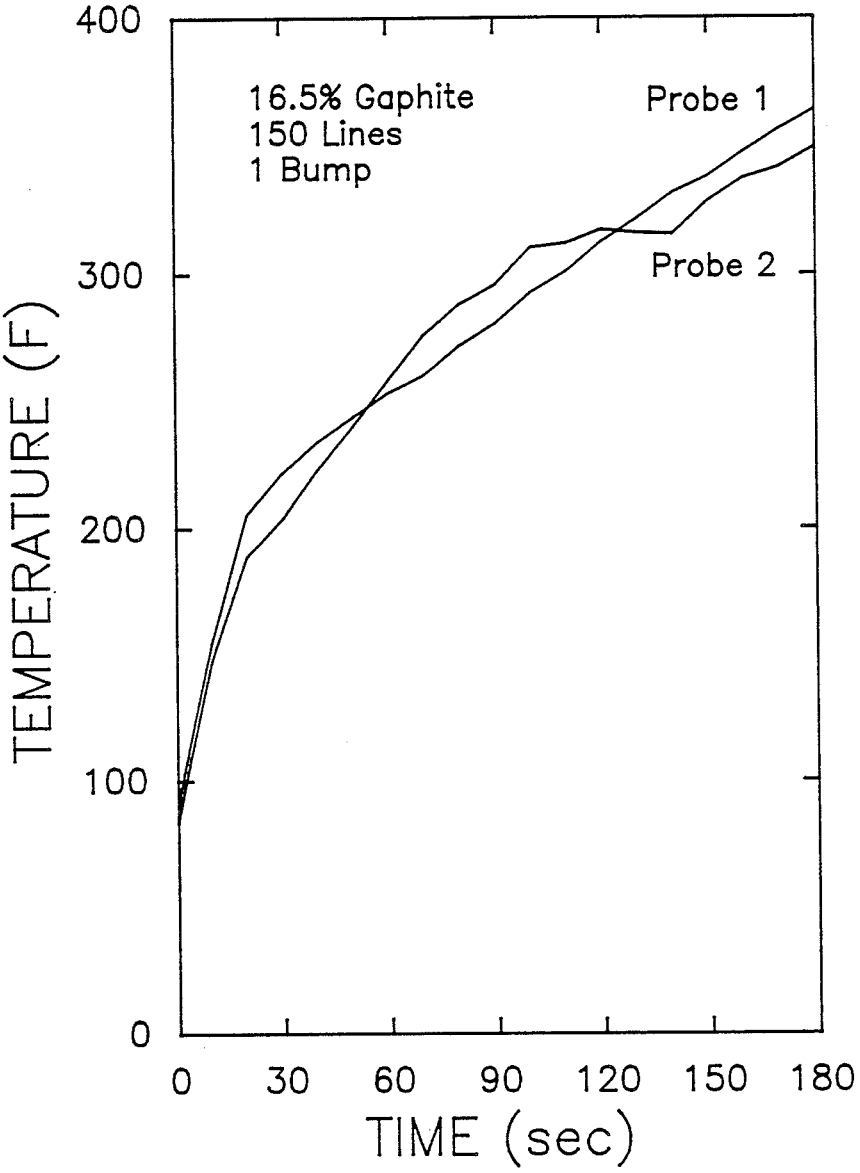
FIG. 3 is a time-temperature graph substantially as shown in FIG. 2 of susceptor-ink composition II printed one bump.
Figure 4:
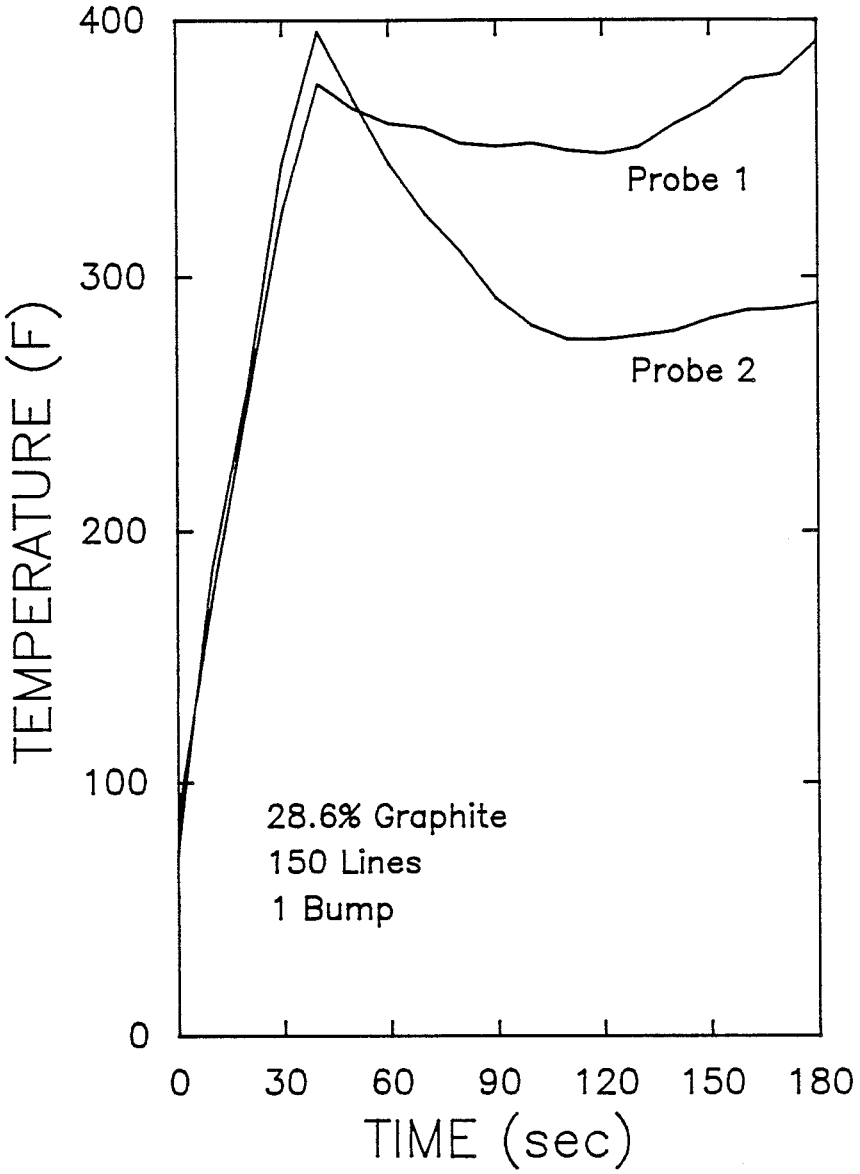
FIG. 4 is a time-temperature graph of susceptor-ink composition III printer one bump.

Since each food product has a unique and optimum time-temperature profile for uniform cooking, or browning and crisping in the microwave oven, one object of the present invention is to tailor the location and concentration of the susceptor material in the food package to match to time-temperature profile for each food product. For instance, as shown in FIG. 2, the addition of about 9% graphite to a susceptor-ink which is printed on a paperboard substrate using a gravure cylinder having 150 lines per inch, one bump, produces a time-temperature profile where the temperature rises from ambient to about 200 degrees F. during the first 30 seconds of cooking time in the microwave and then increases slightly before leveling off. Increasing the graphite content to about 17% as shown in FIG. 3, under the same conditions and on the same press, a time-temperature profile is achieved that reacts about the same as shown in FIG. 2 during the first 30 seconds of cooking time, but thereafter rises to about 325–375 degrees F. during the next two minutes of cooking. When the graphite content is increased to about 29% under the same conditions and on the same press, the temperature rises rapidly during the first 30 seconds of cooking time from ambient temperature to about 350° F. as shown in FIG. 4. If two bumps of the susceptor material are printed on the paperboard substrate with the same press using a susceptor ink containing about 29% graphite, the temperature will rise even more rapidly to nearly 400 degrees F. during during the first 30 seconds of cooking time, before the temperature levels off as shown in FIG. 5.

Accordingly, it may be seen that the efficiency of the susceptor packaging material prepared according to the present invention varies with the concentration of the conductive carbon included in the printed susceptor or the thickness of the susceptor layer.

Figure 5:
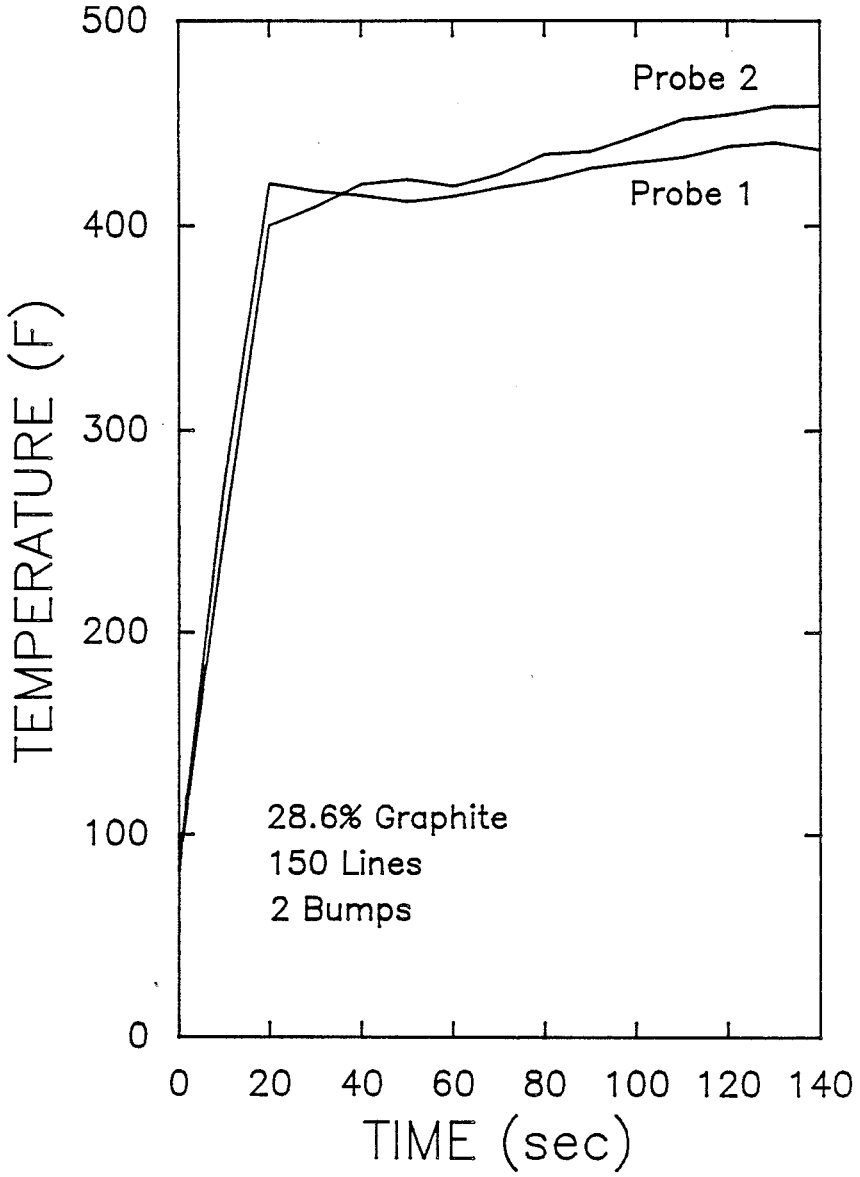
FIG. 5 is a time-temperature graph of susceptor-ink composition III printed two bumps.
Figure 6:
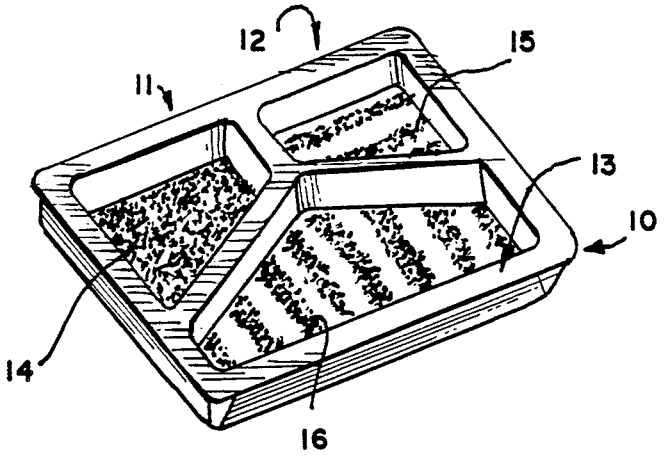
FIG. 6 is a perspective view of a typical food carton prepared from the susceptor packaging material of the present invention showing different concentrations of susceptor material in each food compartment; and, FIG. 7 is a perspective view of a typical food carton having a susceptor pattern printed on the packaging material according to the present invention.
Figure 7:
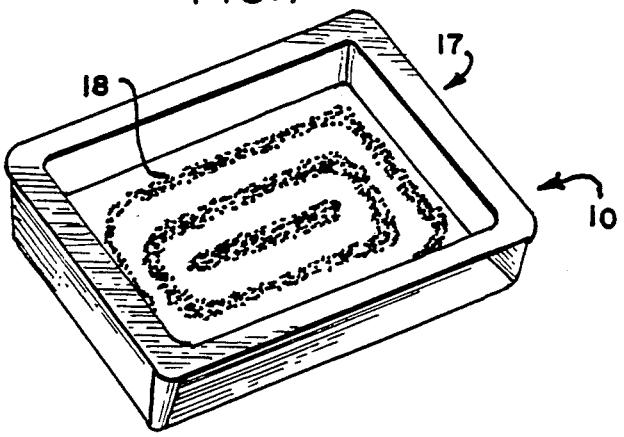

FIGS. 5 and 6 illustrate typical food packages which can be made using the packaging material of the present invention. FIG. 5 illustrates a fully gusseted, flanged tray 10 with three food compartments 11, 12 and 13 wherein the pattern and concentration of susceptor material is different in each compartment. For instance, the pattern 13 selected for compartment 16 would produce a grill-like cooking effect for the main course. The heavy concentration of susceptor-ink 14 in compartment 11 would be useful for browning and crisping a starchy vegetable like french fries, and the less dense susceptor-ink 15 in compartment 12 would be useful for cooking a second vegetable. The food tray 10 in FIG. 6 has a single compartment 17 with a printed susceptor pattern in the form of a typical electric stove element.

While only preferred embodiments of the present invention have been fully shown and described, various modifications and substitutions may be made in the present invention without departing from the spirit and scope of the appended claims.

What is claimed is:

1. The method of making susceptor packaging material on a printing press for use in the manufacture of packages for microwave ovens comprising:

(a) selecting a dielectric substrate for the susceptor packaging material having a food contact surface and an outer surface which will permit the passage of microwave energy therethrough;

(b) preparing a susceptor-ink composition for printing on the food contact surface of the susceptor packaging material comprising on ink vehicle consisting essentially of resins selected from the group consisting of cellulose nitrate, cellulose acetate, methyl cellulose, ethyl cellulose and cellulose acetate butyrate and solvents selected from the group consisting of ethyl alcohol, allyl, amyl, benzyl, butyl, cetyl, isobutyl, ispropyl and propyl alcohol into which there is incorporated a conductive carbon material;

(c) printing the susceptor-ink composition of step (b) onto the food contact surface of the dielectric substrate on a printing press, in a preselected pattern corresponding to the location of food place in packages made from the susceptor packaging material;

(d) overcoating the susceptor-ink printed food contact surface of the susceptor packaging material with a food contacting coating to provide a food contact surface for food packaged in said packaging material; and, (e) further printing the outer surface of said susceptor packaging material with graphics to describe the food placed in the packages made form the susceptor packaging material.

2. The method of claim 1 wherein the printing process is a gravure printing process.

3. The method of claim 2 wherein the dielectric substrate is paperboard.

4. The method of claim 3 wherein the dielectric substrate is precoated on its outer surface with a clay coating.

5. The method of claim 4 wherein the susceptorink printed surface of the dielectric substrate is precoated with a polymeric coating.

6. The method of claim 2 wherein the susceptor-ink composition is applied to the dielectric substrate to provide a surface resistivity of from about 50–5000 ohms per square within the preselected pattern.

7. The method of claim 6 wherein the concentration of conductive carbon material in the susceptor-ink composition comprises from about 9% to 29% by weight of the susceptor-ink composition to achieve the desired surface resistivity.

8. The method of claim 6 wherein the thickness of the susceptor-ink composition applied to the dielectric substrate is varied to achieve the desired surface resistivity.

9. The method of claim 8 wherein the surface resistivity is varied within the preselected pattern printed on the dielectric substrate.

10. A printed food container for use in a microwave oven prepared from susceptor packaging material comprising:

(a) a container body formed from a dielectric substrate having a solvent based susceptor-ink composition printed on the food contact surface thereof in a preselected pattern corresponding to the location of food placed in the container, said susceptor-ink composition containing conductive carbon particles suspended in a mixture of resins and solvents comprising polymeric cellulosic resins soluble in alcohol, to provide a surface resistivity within the preselected printed area in the range of from about 50–5000 ohms per square; and, (b) a barrier coating applied over the printed susceptor-ink composition to provide a food contact surface for food packaged in the container.

11. A printed, ovenable food container according to claim 10 wherein the thickness of the susceptor-ink composition is varied within the preselected pattern printed on the dielectric substrate.

12. A printed, ovenable food container according to claim 10 wherein the concentration of the conductive carbon particles in the susceptor-ink composition is varied within the preselected pattern printed on the dielectric substrate.

13. A printed, ovenable food container according to claim 12 comprising a fully gusseted, flanged tray having multiple food compartments.

14. A printed, ovenable food container according to claim 12 comprising a fully gusseted, flanged tray having a single food compartment.

* * * * *